US007778582B2

(12) United States Patent
Miki et al.

(10) Patent No.: US 7,778,582 B2
(45) Date of Patent: Aug. 17, 2010

(54) IMAGE HEATING APPARATUS WITH FRAME ACCOMMODATING APPARATUS COMPONENTS

(75) Inventors: Tsutomu Miki, Odawara (JP); Kazuhisa Kemmochi, Suntoh-gun (JP); Hikaru Osada, Mishima (JP); Masao Umezawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 284 days.

(21) Appl. No.: 11/844,100

(22) Filed: Aug. 23, 2007

(65) Prior Publication Data

US 2008/0050155 A1 Feb. 28, 2008

(30) Foreign Application Priority Data

Aug. 24, 2006 (JP) ..... 2006-228462

(51) Int. Cl.
*G03G 15/20* (2006.01)

(52) U.S. Cl. ..... 399/329

(58) Field of Classification Search ..... 399/328, 399/329, 330, 331, 122; 219/216
See application file for complete search history.

(56) References Cited

U.S. PATENT DOCUMENTS

| | | | | |
|---|---|---|---|---|
| 3,998,584 | A * | 12/1976 | Wada et al. | 432/60 |
| 4,618,240 | A * | 10/1986 | Sakurai et al. | 219/216 |
| 5,083,168 | A | 1/1992 | Kusaka et al. | 355/285 |
| 5,149,941 | A | 9/1992 | Hirabayashi et al. | 219/216 |
| 5,162,634 | A | 11/1992 | Kusaka et al. | 219/216 |
| 5,210,579 | A | 5/1993 | Setoriyama et al. | 355/285 |
| 5,262,834 | A | 11/1993 | Kusaka et al. | 355/285 |
| 5,300,997 | A | 4/1994 | Hirabayashi et al. | 355/285 |
| 5,343,280 | A | 8/1994 | Hirabayashi et al. | 355/285 |
| 5,525,775 | A | 6/1996 | Setoriyama et al. | 219/216 |
| 5,742,878 | A * | 4/1998 | Kuroda | 399/122 |
| 5,767,484 | A | 6/1998 | Hirabayashi et al. | 219/126 |
| 5,903,810 | A * | 5/1999 | Adachi | 399/328 |
| 7,013,099 | B2 * | 3/2006 | Shirakata | 399/92 |
| 7,398,048 | B2 * | 7/2008 | Tomatsu | 399/401 |

FOREIGN PATENT DOCUMENTS

| | | | |
|---|---|---|---|
| JP | 63-313182 | | 12/1988 |
| JP | 2-157878 | | 6/1990 |
| JP | 4-044075 | | 2/1992 |
| JP | 4-204980 | | 7/1992 |
| JP | 5-134572 | | 5/1993 |
| JP | 05134572 | A * | 5/1993 |
| JP | 5-188805 | | 7/1993 |
| JP | 05188805 | A * | 7/1993 |
| JP | 06059596 | A * | 3/1994 |
| JP | 2000194207 | A * | 7/2000 |
| JP | 2004177573 | A * | 6/2004 |

* cited by examiner

*Primary Examiner*—Robert Beatty
(74) *Attorney, Agent, or Firm*—Fitzpatrick, Cella, Harper & Scinto

(57) ABSTRACT

The image heating apparatus includes a rotary member that comes into contact with a toner image borne on a recording material, a backup member that forms a nip portion to pinch and convey the recording material with said rotary member, wherein said rotary member heats the toner image on the recording material in the nip portion, a cover member that covers a surface of said rotary member with a gap between the surface of said rotary member and the cover member and a frame that accommodates said rotary member, said backup member and said cover, wherein said cover is not in contact with said frame. This structure can suppress heat dissipation to the exterior of the image heating apparatus, thus suppressing the energy consumption.

2 Claims, 9 Drawing Sheets

PRIOR ART

PRIOR ART

IMAGE HEATING APPARATUS WITH FRAME ACCOMMODATING APPARATUS COMPONENTS

BACKGROUND OF THE INVENTION

1. Field of the Invention

The present invention relates to an image heating apparatus adapted for use as a heat fixing apparatus to be mounted on an image forming apparatus such as a copying machine or a printer utilizing electrophotographic recording technology.

2. Description of the Related Art

In a prior image forming apparatus, an image is formed on an image bearing member by an appropriate image forming process such as an electrophotographic process, then such image is either directly or indirectly borne on a recording material, and such unfixed image (toner image) is heat fixed, by a fixing apparatus, on the surface of the recording material as a permanently fixed image. For such fixing apparatus, an apparatus of heat roller type has been widely utilized. Also in recent years, an apparatus of film heating type has been commercialized from the standpoints of quick starting and energy saving. Also proposed is an apparatus of electromagnetic induction heating type, in which heat is generated in a film itself constituted of a metal.

In the following, a fixing apparatus of film heating type will be described as a representative example.

Such a film heating type of a fixing apparatus is described, for example, in Japanese Patent Application Laid-Open No. S63-313182, Japanese Patent Application Laid-Open No. H02-157878, Japanese Patent Application Laid-Open No. H04-44075, and Japanese Patent Application Laid-Open No. H04-204980.

FIG. 9 illustrates schematic structure of an example of the fixing apparatus of film heating type.

The fixing apparatus 1 of this example includes a fixing film 10 of a cylindrical shape, formed by a heat-resistant resin such as polyimide and constituting a rotary member unit 2 at a heat source side. The cylindrical film 10 is loosely fitted around a film guide member 16 having a substantially semi-circular trough-shaped cross section.

Inside the film guide member 16, there is provided a laterally oblong linear heat-generating unit (ceramic heater) 15 of a low heat capacity, which is prepared by forming a heating member 13 on a heater substrate 14 constituted of a ceramic substrate such as of alumina ($Al_2O_3$). Glass or a fluorinated resin is coated as an overcoat layer (protective layer) 12 so as to cover the heating member 13.

An elastic pressure roller constituting a pressurizing rotary member 3 is pressed to the ceramic heater 15 across the fixing film 10, thereby forming a fixing nip portion N.

The pressure roller 3 is rotated by a drive unit M, counter-clockwise as indicated by an arrow. The rotating drive of the pressure roller 3 applies a rotary power to the fixing film 10, by a frictional force between the pressure roller 3 and the external surface of the fixing film 10. Therefore, the fixing film 10 rotates clockwise, as indicated by an arrow, with the internal surface thereof in sliding contact with the ceramic heater at the fixing nip portion N, with a peripheral speed approximately corresponding to the peripheral speed of the pressure roller 3. Thus, the fixing apparatus of this example is a fixing apparatus of so-called film heating type, and a pressure roller drive type.

The film guide member 16 serves to support the heat-generating unit 15, to support the fixing film 10 and to stabilize the movement of the film 10 in rotation.

The fixing film 10 is constituted of an unillustrated polyimide base layer (about 50 μm), an electroconductive primer layer (5 μm), and a release layer of a fluorinated resin provided thereon. Also in a fixing apparatus for a full-color image forming apparatus, designed for fixing a color image having a larger toner amount, there is employed, in order to improve the fixing ability, a fixing film having a silicone rubber layer (100 μm or larger) between the conductive primer layer and the release layer of fluorinated resin. This allows the fixing film 10 to follow the surface irregularities of the recording material, thereby avoiding image defects such as unevenness in gloss.

The temperature of the fixing nip portion N is regulated by a temperature control system including a temperature detection unit 11, such as a thermistor, mounted on a rear surface of the ceramic heater 15.

A recording material P, conveyed from an unillustrated image forming portion and bearing an unfixed toner image T, is introduced between the fixing film 10 and the pressure roller 3 in the fixing nip portion N, with the toner image bearing surface upwards, namely opposed to the surface of the fixing film. In the fixing apparatus 1, the image bearing surface is pinched and conveyed in the fixing nip portion N, in close contact with the external surface of the fixing film 10 and together with the fixing film 10, through the fixing nip portion N. While the recording material P is pinched and conveyed, together with the fixing film 10, through the fixing nip portion N, the unfixed toner image T on the recording material P is heat fixed thereto. The recording material P, upon passing through the fixing nip portion N, is separated from the external surface of the rotary fixing film 10 and is further conveyed for discharging.

In the foregoing, a fixing apparatus of film heating type has been described as an example, but, in any fixing apparatus of different heat-generating system, the unfixed toner image on the recording material is heat fixed thereto by the heat from a heat source-side rotary member unit.

The heat (energy) from the heat source-side rotary member unit is transmitted not only to the unfixed toner image and the recording material, but also to the exterior through the air around the heat source-side rotary member unit and through other members in contact with the heat source-side rotary member unit. It is preferable that energy not contributing to the fixation is made as little as possible. Therefore, following technology is proposed as a heat shield method for preventing the heat, generated from the heat source-side rotary member unit, from diffusion to the exterior of the fixing apparatus.

FIG. 10 illustrates an example of the heat shield technology for the fixing apparatus of heat roller type. In this fixing apparatus, a heat shield cover 200 is provided around the fixing roller 4, which is one of the members constituting the heat source-side rotary member unit 2. Such construction intercepts the heat radiation from the fixing roller 4 and also suppresses the heat transmission by a convection in the air layer around the fixing roller 4, thereby preventing the heat diffusion to the exterior of the fixing apparatus. In addition, a heat shield effect of an air layer in a space S, surrounded by the heat shield cover 200 and an outside frame 5 of the heat source-side rotary member unit 2, prevents an unnecessary heat transmission to the exterior of the fixing apparatus.

Similar heat shield technologies are disclosed in Japanese Patent Application Laid-Open No. H05-134572 and Japanese Patent Application Laid-Open No. H05-188805. In either technology, a heat shield cover 200 or a reflecting plate is disposed outside the heat source-side rotary member unit 2 to intercept the externally diffusing heat, thereby improving the thermal efficiency of the entire fixing apparatus. However, the fixing apparatus of the aforementioned construction is associated with following shortcomings.

For example, as illustrated in FIG. 10, the heat shield cover 200 is in contact with the external frame 5 of the heat source-side rotary member unit 2 (namely frame of the fixing apparatus).

Such contact of the heat shield cover 200 and the frame 5 causes a heat transmission from the heat shield cover 200, heated by the heat radiation from the fixing roller 4, to the external frame 5 of the heat source-side rotary member unit 2, thereby heating the frame 5. The frame 5 is positioned closer to the external wall of the printer, in which the fixing apparatus is mounted, and is easier to cause heat dissipation. Such construction inducing an easy heat transmission to the frame 5 results in a waste of energy. Thus, the technologies of the prior references still have room for improvement.

SUMMARY OF THE INVENTION

The present invention has been made in consideration of the aforementioned drawback.

A purpose of the preset invention is to provide an image heating apparatus capable of suppressing heat dissipation to the exterior of the apparatus.

Another purpose of the present invention is to provide an image heating apparatus, capable of suppressing energy consumption.

A further object of the present invention is to provide An image heating apparatus, comprising a rotary member that comes into contact with a toner image borne on a recording material, a backup member that forms a nip portion to pinch and convey the recording material with said rotary member, wherein said rotary member heats the toner image on the recording material in the nip portion, a cover member that covers a surface of said rotary member with a gap between the surface of said rotary member and the cover member; and a frame that accommodates said rotary member, said backup member and said cover, wherein said cover is not in contact with said frame. an image heating apparatus, which includes a rotary member to be in contact with a toner image borne on a recording material, a backup member for forming a nip portion, in cooperation with said rotary member, for pinching and conveying the recording material, wherein the rotary member is adapted to heat the toner image on the recording material in the nip portion; a cover covering a surface of the rotary member with a gap to the surface of the rotary member; and a frame accommodating said rotary member, said backup member and said cover, wherein said cover is not in contact with said frame.

Further features of the present invention will become apparatus from the following description of exemplary embodiments with reference to the attached drawings.

DESCRIPTION OF THE EMBODIMENTS

Now the image heating apparatus of the present invention will be clarified further, with reference to the accompanying drawings.

Exemplary Embodiment 1

(1) Image Forming Apparatus

Figure 1:
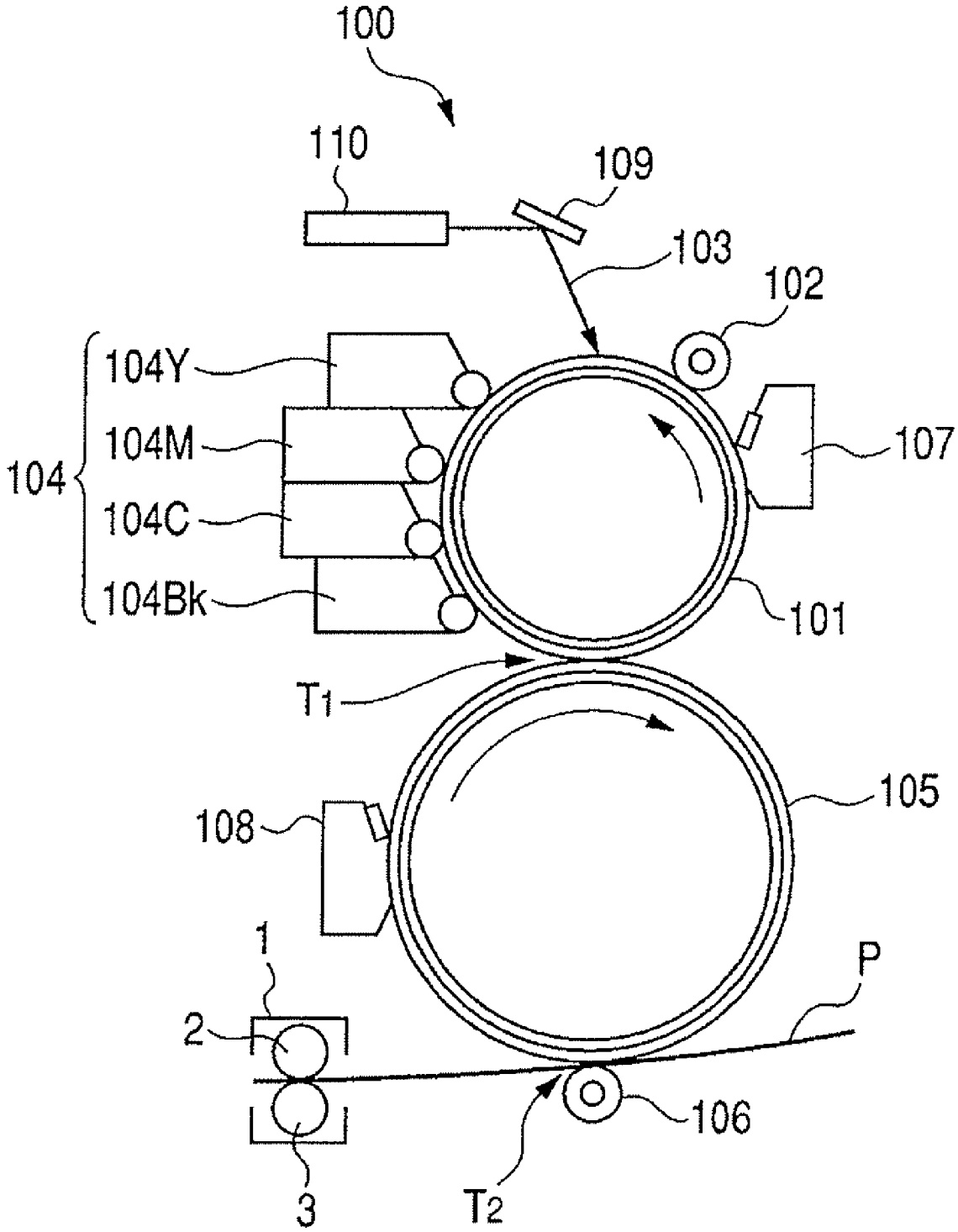
FIG. 1 is a schematic cross-sectional view of an image forming apparatus in which an image heating apparatus of the present invention is mounted as a heat fixing apparatus.

FIG. 1 illustrates schematic construction of a color laser beam printer of electrophotographic process, constituting an exemplary embodiment of an image forming apparatus 100.

Referring to FIG. 1, the image forming apparatus 100 includes an organic photosensitive member or an amorphous silicon photosensitive member of a drum shape (hereinafter called "photosensitive drum") 101, serving as an image bearing member constituting an image forming unit. The photosensitive drum 101 is rotated, counterclockwise as indicated by an arrow, with a predetermined process speed (peripheral speed). As the image forming unit, there are provided, around the photosensitive drum 101, a charging roller 102 as a charging unit, a laser optics (laser scanner) 110 as an exposure unit, and a 4-color developing apparatus 104 as a development unit.

The photosensitive drum 101, in the course of rotation thereof, is subjected to a uniform charging of predetermined polarity and potential by the charging roller 102.

Then, thus charged surface is scan exposed by a laser beam 103 emitted from the laser optics 110. The laser optics 110 outputs a laser beam 103 which is modulated (on/off controlled) according to image information from an unillustrated image signal generating apparatus. The laser beam 103 from the laser optics 110 is deflected by a mirror 109 onto an exposure position on the photosensitive drum 101, thereby forming an electrostatic latent image corresponding to the image information, on the surface of the photosensitive drum 101.

In case of forming a full-color image, at first a scan exposure and a latent image formation are executed for a first color-separated component of the desired full-color image, for example a yellow component image. The latent image thus formed is developed, by the function of a yellow developing device 104Y within the 4-color developing apparatus 104, as a yellow toner image. Such yellow toner image is transferred onto an intermediate transfer drum 105, at a primary transfer portion T1 formed in a contact position (or vicinity thereof) of the photosensitive drum 101 and the intermediate transfer drum (intermediate transfer member) 105.

After the toner image transfer to the intermediate transfer drum 105, the surface of the photosensitive drum 101 is subjected to a removal of deposited residues such as a transfer residual toner by a cleaner 107, and is thus cleaned.

Then a process cycle of the charging, scan exposure, development, primary transfer and cleaning as described above is executed for a second color-separated component (for example a magenta component image) of the desired full-color image. Subsequently, it is executed in succession for a third color-separated component (for example a cyan component image) and a fourth color-separated component (for example a black component image).

In this manner, 4-color toner images, namely a yellow toner image, a magenta toner image, a cyan toner image and a black toner image are transferred in succession and in superposition on the surface of the intermediate transfer drum 105, thereby forming a color toner image corresponding to the desired full-color image.

The intermediate transfer drum 105 is formed by providing an elastic layer of a medium resistance and a surface layer of a high resistance on a metal drum, positioned in contact with or in the proximity of the photosensitive drum 101 and is driven clockwise, as indicated by arrow, with a peripheral speed substantially same as that of the photosensitive drum 101. A bias potential is given to the metal drum of the intermediate transfer drum 105, and by a potential difference from that of the photosensitive drum 101, the toner image on the photosensitive drum 101 is transferred onto the intermediate transfer drum 105.

The color toner image formed on the intermediate transfer drum 105 is transferred, at a secondary transfer portion T2 formed in a contact nip portion of the intermediate transfer drum 105 and a transfer roller 106 (transfer unit), onto the surface of a recording material P. The recording material P is supplied, from an unillustrated sheet feeding portion, at a predetermined timing into the secondary transfer portion T2.

The transfer roller 106 supplies a charge of a polarity opposite to that of the toner, from the rear side of the recording material P, whereby the synthetic color toner image is collectively transferred from the surface of the intermediate transfer drum 105 onto the recording material P.

The recording material P, after passing the secondary transfer portion T2, is separated from the surface of the intermediate transfer drum 105, then is introduced into the fixing apparatus 1, in which the unfixed toner image is subjected to a heat fixing process, and is then discharged to an unillustrated discharge sheet tray outside the apparatus.

The intermediate transfer drum 105, after the transfer of the color toner image onto the recording material P, is subjected to elimination of deposited residues such as transfer residual toner and paper dusts by a cleaner 108 and is thus cleaned. The cleaner 108 is maintained in a state not in contact with the intermediate transfer drum 105 while the cleaning operation is not executed, and is maintained in a state in contact with the intermediate transfer drum 105 during the execution of the secondary transfer of the color toner image from the intermediate transfer drum 105 onto the recording material P.

Also the transfer roller 106 is maintained in a state not in contact with the intermediate transfer drum 105 while the secondary transfer is not executed, and is maintained in a state in contact with the intermediate transfer drum 105 across the recording material P, during the execution of the secondary transfer of the color toner image from the intermediate transfer drum 105 onto the recording material P.

The image forming apparatus of the present exemplary embodiment is also capable of executing a print mode for a monochromatic image such as a black-and-white image, and also capable of executing a both-side print mode.

In case of a both-side print mode, the recording material P, after image printing on a first side and after emerging from the fixing apparatus 1, is subjected to a front-rear reversing operation in an unillustrated recycling mechanism and is fed again to the secondary transfer portion T2 for the toner image transfer onto the rear surface. Then it is introduced again into the fixing apparatus 1 for the fixation of the toner image on the rear surface, whereby a both-side image print is obtained.

(2) Fixing Apparatus (Image Heating Apparatus) 1

(Entire Structure)

Figure 2:
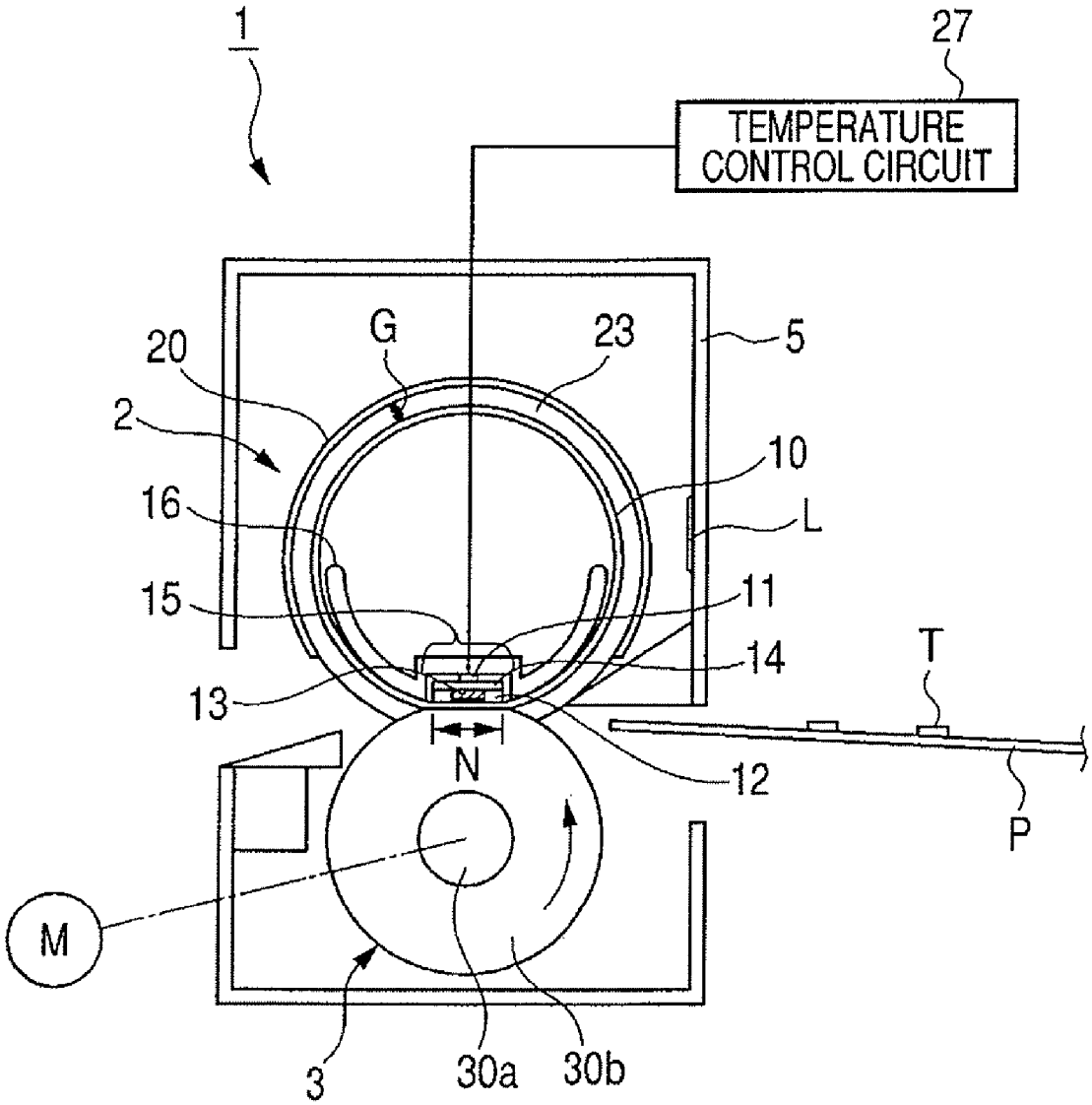
FIG. 2 is a cross-sectional view of a fixing apparatus of film heating type, constituting an exemplary embodiment 1 of the present invention.
Figure 3A:
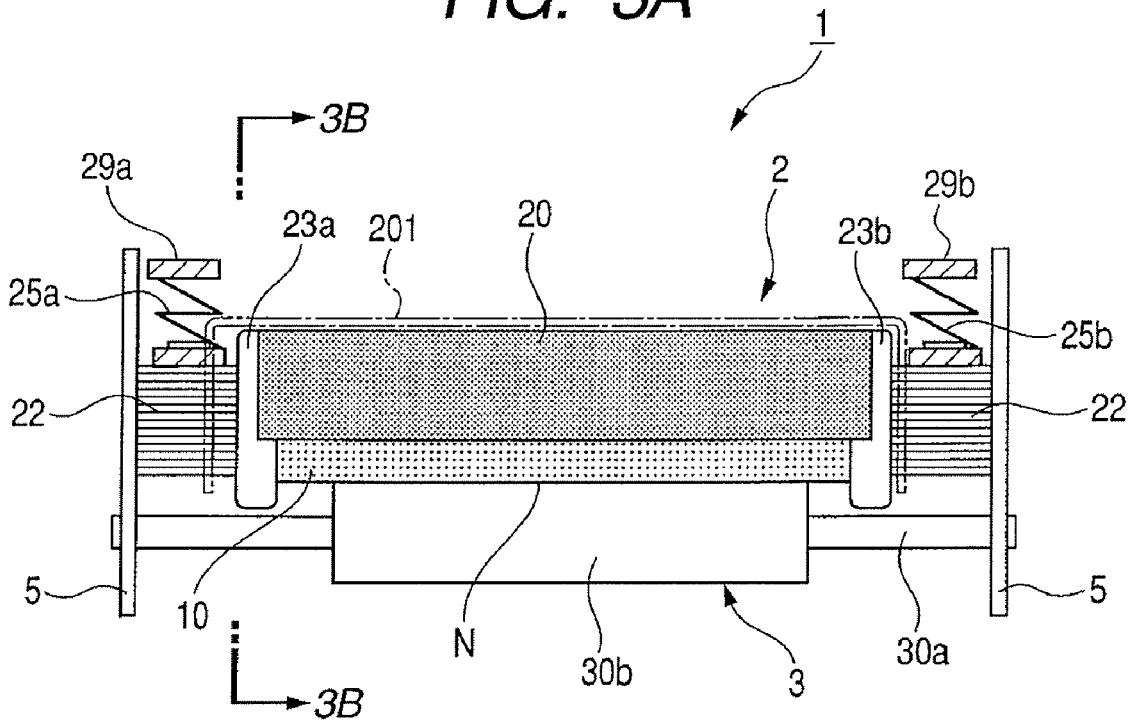
FIG. 3A is an elevation view of the fixing apparatus of film heating type illustrated in FIG. 2.
Figure 3B:
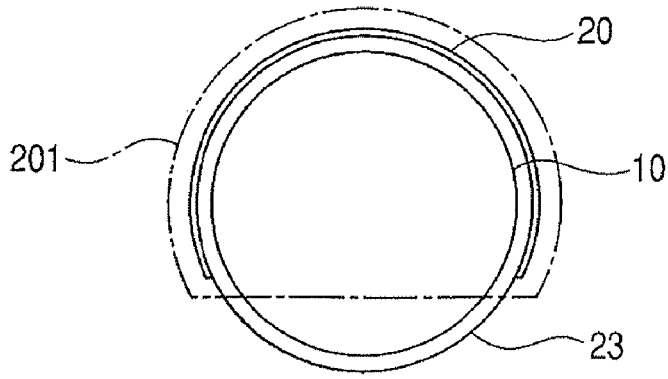
FIG. 3B is a cross-sectional view along a line 3B-3B in FIG. 3A.

Now the fixing apparatus 1 will be described with reference to FIGS. 2 and 3. In the present exemplary embodiment, the fixing apparatus 1 is of film heating type and of pressure roller drive type. FIG. 2 is a lateral cross-sectional view, illustrating the schematic structure of the principal parts of the fixing apparatus 1. FIG. 3A is an elevation view illustrating the schematic structure of the principal parts of the fixing apparatus 1, and FIG. 3B is a cross-sectional view along a line 3B-3B in FIG. 3A and illustrating a schematic structure when a heat shield cover 20 is provided on an end flange member 23.

In the present exemplary embodiment, the fixing apparatus 1 includes a frame member 5, and a heat source-side rotary member unit 2 and a pressurizing rotary member (backup member) 3 which are accommodated in the frame member 5 and are pressed with each other to constitute the nip area N. The recording material bearing the toner image is heated while it is pinched and conveyed by the fixing nip portion N.

In more details, the heat source-side rotary member unit 2 includes a cylindrical fixing film 10, and a ceramic heater 15 serving as a heat-generating unit, and the ceramic heater is constituted of a ceramic substrate 14, a heating member 13 and an overcoat layer 12.

The ceramic substrate 14 is advantageously formed by a heat-resistant material such as alumina ($Al_2O_3$). The heating member 13 is formed by coating and sintering an electric resistance material such as Ag/Pd (silver-palladium) for example by screen printing method, on the substrate 14. The heating member 13 is connected to an unillustrated power source, and the heating member 13 generates heat by a current supplied from such power source.

The fixing apparatus 1 includes a film guide member 16 of a substantially semicircular trough-shaped cross section, on which the cylindrical fixing film 10 is loosely fitted. The film guide member 16 also supports the ceramic heater 15.

As illustrated in FIG. 3A, flange members (regulation members) 23*a*, 23*b* are mounted on lateral ends of the film guide member 16. The flange members 23*a*, 23*b* serve to fix the lateral position of the film guide member 16 and to receive the end portions of the fixing film 10 at the rotation of the fixing film 10, thereby restricting a displacement of the fixing film along the longitudinal direction of the film guide member.

The pressure roller 3 serving as a backup member is constituted of a metal core 30*a*, and a heat-resistant elastic layer 30*b* of silicone rubber, fluorinated rubber or fluorinated resin. Both ends of the metal core 30*a* are rotatably supported in the frame 5 of the fixing apparatus.

In a metal stay 22, pressurizing springs 25*a*, 25*b* are pressed respectively between both ends of the metal stay 22 and spring-receiving members 29*a*, 29*b* of the frame 5 of the apparatus, thereby applying a press-down force to the stay 22. Thus a lower surface of the ceramic heater 15 corresponding to the nip portion N and an upper surface of the pressure roller 3 are pressed with each other across the fixing film 10, thereby forming the fixing nip portion N of a predetermined width.

The pressure roller 3 is rotated by a drive unit M, counter-clockwise as indicated by an arrow. The rotating drive of the pressure roller 3 applies a rotary power to the fixing film 10, by a frictional force between the pressure roller 3 and the external surface of the fixing film 10. Therefore, the fixing film 10 rotates clockwise, as indicated by an arrow, with the internal surface thereof in sliding contact with the lower surface of the ceramic heater 15 at the fixing nip N, with a peripheral speed approximately corresponding to the peripheral speed of the pressure roller 3.

In this structure, in order to reduce the mutual sliding frictional force between the lower surface of the ceramic heater 15 and the internal surface of the fixing film 10 at the fixing nip portion N, a lubricant such as heat-resistant grease is made present between the lower surface of the ceramic heater 15 and the internal surface of the fixing film 10. Otherwise, the lower surface of the ceramic heater 15 may be coated with a lubricating member 41 (not illustrated).

Also unillustrated rib portions are formed on the periphery of the film guide member 16, at a predetermined pitch along the longitudinal direction thereof, to reduce the frictional resistance between the periphery of the film guide member 16 and the internal surface of the fixing film 10, thereby lowering the rotational load on the fixing film 10.

The temperature of the fixing nip portion N is controlled by a temperature control circuit 27, including a temperature detecting unit 11. During the fixing process, the temperature control circuit 27 controls the current supply from the power source to the heating member 13, in such a manner that the temperature detected by the temperature detecting unit 11 is maintained at a target temperature.

The temperature detecting unit 11 is a temperature sensor such as a thermistor for detecting the temperature of the heater 15, and, in the present exemplary embodiment, the temperature of the fixing nip portion N is controlled, based on the temperature information of the heater 15 measured by the temperature sensor 11.

In a state where the fixing nip portion N is heated to and controlled at a predetermined temperature, the recording material P, bearing an unfixed toner image T is introduced into the fixing nip portion N. In the fixing nip portion N, the image bearing surface of the recording material comes in close contact with the external surface of the fixing film 10, and it is pinched and conveyed, together with the fixing film 10, in the fixing nip portion N.

In the course that the recording material P is pinched and conveyed, together with the fixing film 10, in the fixing nip portion N, the unfixed toner image T on the recording material P is heated by the heat of the fixing film 10, heated by the ceramic heater 15. Upon passing the fixing nip portion N, the recording material P is separated from the external surface of the fixing film 10 and is further conveyed for being discharged. The unfixed toner image T on the recording material P, after passing the fixing nip portion N, is cooled to become a permanently fixed image.

In the present exemplary embodiment, the fixing apparatus is not equipped with an oil coating mechanism for preventing offset phenomenon, because a toner containing a substance softenable at a low temperature is used in the unfixed toner image T, but an oil coating mechanism may be provided in the case of utilizing a toner not containing such low-temperature softenable substance. Also even in case of utilizing a toner containing the low-temperature softable substance, an oil coating or a separation under cooling may be conducted.

(Fixing Film 10)

Figure 4:
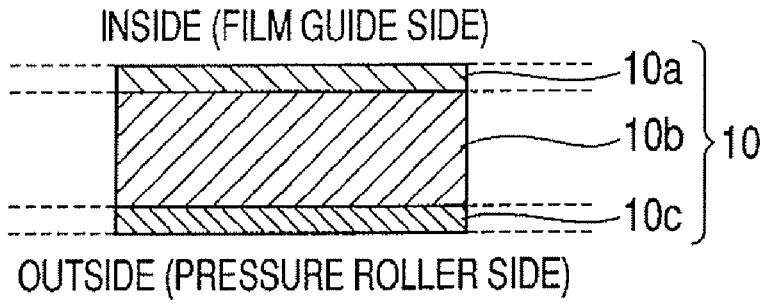
FIG. 4 is a cross-sectional view illustrating a layered structure of a fixing film.

FIG. 4 is a schematic view illustrating a layered structure of the fixing film 10 in the present exemplary embodiment. In the present exemplary embodiment, the fixing film 10 constitutes a rotary member, coming into contact with the toner image on the recording material. The fixing film is made flexible. The fixing film 10 of the present exemplary embodiment is constituted of, on a polyimide substrate layer 10*a* (50 μm), an unillustrated primer layer (5 μm), an elastic layer 10*b* (300 μm or less) thereon and a release layer 10*c* of a fluorinated resin further thereon. The elastic layer 10*b* is formed by a material with a satisfactory heat resistance and a satisfactory thermal conductivity, such as silicone rubber, fluorinated rubber or fluorosilicone rubber, and is preferably formed with a thickness of from 10 to 500 μm and a hardness (JIS-A hardness) of 60° or less.

The elastic layer 10*b* preferably has a thermal conductivity λ of from 0.25 to 0.85 [W/m·K].

In the case that the thermal conductivity λ is less than the range of from 0.25 to 0.85 [W/m·K], the thermal resistance is large thereby retarding the temperature increase on the surface layer (release layer 10*c*) of the fixing film. On the other hand, in the case that the thermal conductivity λ is larger than the range of from 0.25 to 0.85 [W/m·K], the hardness becomes excessively high thereby deteriorating the distortion under compression.

The release layer 10*c* is formed by a material having a satisfactory releasing property and a satisfactory thermal resistance, such as a fluorinated resin (PFA, PTFE, FEP), silicone resin, fluorosilicone rubber, fluorinated rubber, or silicone rubber, having a thickness of from 1 to 100 μm.

A thickness of the release layer 10*c* less than 1 μm results in a portion with poor releasing property because of coating unevenness of the coated film, thereby leading to a drawback such as deficient durability. On the other hand, a thickness of the release layer 10*c* exceeding 100 μm results in a drawback of deterioration in the thermal conductivity, and, particularly in case of a resin-based releasing layer, it becomes excessively hard thereby losing the effect of the elastic layer 10*b*.

In the following, the heat shield cover, characterizing the present invention, will be described.

As illustrated in FIGS. 3A and 3B, the heat shield cover (cover), which covers the surface of the fixing film 10 and has a clearance to the surface of the fixing film 10, is not in contact with the frame 5 of the fixing apparatus, and is mounted on the flange members 23*a*, 23*b*. The frame 5 of the fixing apparatus accommodates the fixing film (rotary member) 10, the pressure roller (backup member) 3, and the insulation cover (cover) 20. A numeral 201 also indicates a heat shield cover, which will be described later in a modified embodiment.

In the present fixing apparatus 1, the heat shield cover 20 is formed by aluminum, in consideration of compactization of the printer and cost thereof. The heat shield cover 20 is made in such a form that can be placed on the flange members 23*a*, 23*b* without a gap thereto. Also the heat shield cover 20 is made to cover about 60% of the surface area of the cylindrical fixing film 10, extending in the longitudinal direction. The coverage of the heat shield cover 20 on the surface of the fixing film 10 is preferably made as large as possible.

The heat shield cover 20 is heated by the heat radiated from the fixing film 10. The heat shield cover 20, being so constructed as to be not in contact with the frame member 5, is not easily cooled after once heated, whereby the air layer between the heat shield cover 20 and the fixing film 10 is also not easily cooled. Therefore, when the heat shield cover 20 is heated promptly, the warming effect for the fixing film 10 is exhibited promptly.

In the case that the heat shield cover 20 is made of a metal such as aluminum as in the present exemplary embodiment, the heat capacity of the heat shield cover 20 becomes larger by increasing the thickness of the heat shield cover 20. As a result, a longer time is required for warming the heat shield cover 20 by the heat from the fixing film 10, thereby retarding the warming effect to be exhibited. Therefore, the heat shield cover 20 preferably has a smaller thickness. However, the heat shield cover 20 is required to have a strength not to be deformed or broken by a jammed recording material, when the recording material P conveyed to the fixing apparatus 1 causes a jamming. Therefore, though variable depending on the material constituting the heat shield cover 20, the thickness of the heat shield cover 20 is preferably selected from 100 μm to 1 mm when aluminum is employed as the material. The thickness was selected as 250 μm in the present exemplary embodiment.

With a large distance (gap) G between the heat shield cover 20 and the fixing film 10, the influence of the spontaneous air convection generated between the fixing film 10 and the heat shield cover 20 becomes larger, whereby the heat of the warmed fixing film 10 is diffused to cause a cooling, thus leading a drawback of an increased energy consumption.

Therefore the distance (gap) G between the heat shield cover 20 and the fixing film 10 is advantageously made smaller, and preferably 2 mm or less. In the present exemplary embodiment, this gap can be easily defined by varying the external diameter of the flange members 23*a*, 23*b*. The gap was selected as about 2 mm in the present exemplary embodiment.

The flange members 23*a*, 23*b* were made of polyphenylene sulfide resin (PPS) having a high heat resistance. In the case that the flange members have a thermal conductivity of a certain high level (1 [W/mK] or higher), heat easily moves from the fixing film 10 to the flange members 23*a*, 23*b*, whereby the temperature of the heat shield cover 20 can easily follow the temperature of the fixing film 10. Therefore, the heat shield cover 20 can be warmed promptly to provide an advantage of a prompt warming effect. On the other hand, in case of employing the flange members having a low thermal conductivity (1 [W/mK] or less), the heat shield cover 20 still provides the effect of intercepting the thermal conduction resulting from the spontaneous air convection, so that flange members having a low thermal conductivity may also be used. The present exemplary embodiment employed PPS resin having a thermal conductivity of 1 [W/mK] or less.

Under such conditions, the surface of the fixing film 10 is covered by the heat shield cover 20, while the end portions of the fixing film 10 are covered by the flange members 23*a*, 23*b*, and the heat shield cover 20 is maintained not in contact with the frame member 5. In this manner the heat diffusion to the exterior of the fixing apparatus is suppressed.

An experiment of measuring the temperature rise in the plate metal (frame of the fixing apparatus) was conducted when 100 recording materials were passed continuously, in each of the apparatus of the present exemplary embodiment equipped with the heat shield cover 20, and an apparatus in which the heat shield cover 20 was detached from the present exemplary embodiment.

More specifically, the temperature change was measured in a metal plate L (FIG. 2) at a distance of about 3 mm from the heat shield cover 20, when the heater 15 was controlled at 180° C. and plain papers of letter size (width 216 mm, length 279 mm) were passed as the recording materials P, at a process speed of 87 mm/sec. The temperature measurement was conducted by pressing a thermocouple to the metal plate L.

Figure 5:
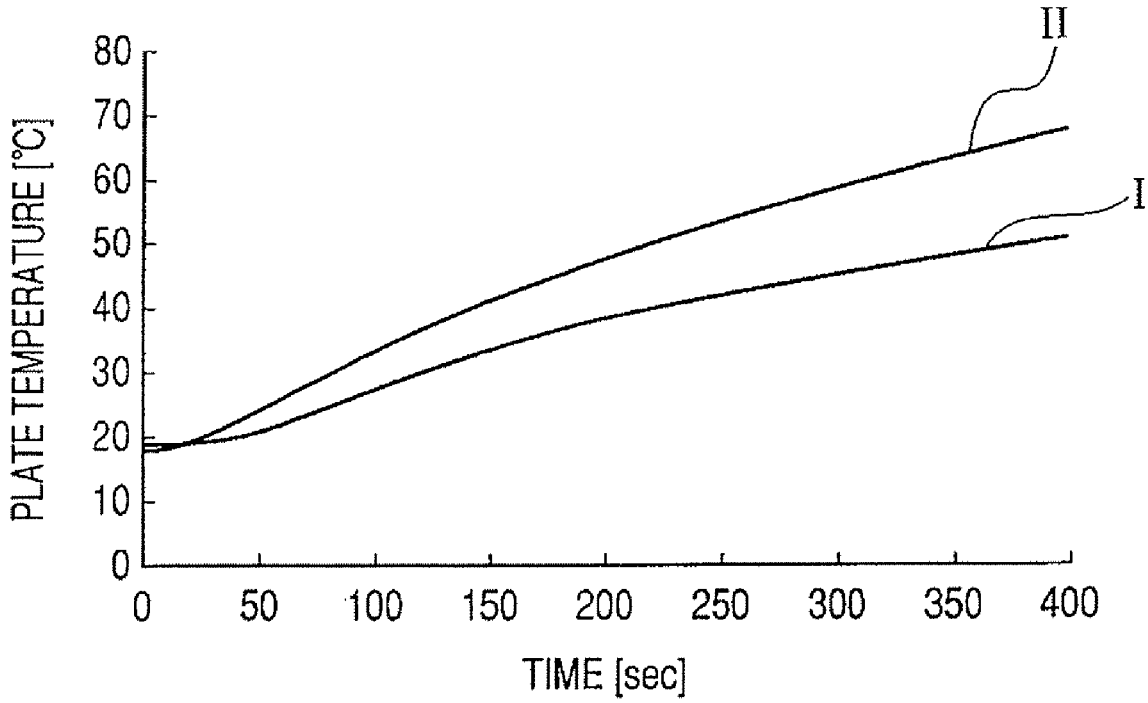
FIG. 5 illustrates a graph obtained from an experiment, indicating the effect of the fixing apparatus of the present invention.

FIG. 5 illustrates the results. A curve I shows the result of the present exemplary embodiment equipped with the heat shield cover 20, and a curve II shows the result of the apparatus from which the heat shield cover 20 is detached.

While the apparatus in which the heat shield cover 20 was detached showed a metal plate temperature of 67° C., the metal plate temperature in the apparatus of the present exemplary embodiment was suppressed to 50° C. Thus, the preventing effect for temperature rise (difference in plate metal temperature) was $\Delta T = -17°$ C.

Thus, the temperature rise in the frame of the fixing apparatus is suppressed in the present exemplary embodiment. In the apparatus of the present exemplary embodiment equipped with the heat shield cover 20, the temperature rise in the metal plate of the frame of the fixing apparatus is suppressed because of the following reasons.

A first reason resides in a fact the heat radiation from the heat shield cover 20 is suppressed as the heat shield cover 20 is not in direct contact with the frame 5 of the fixing apparatus. A second reason resides in a fact that the surface of the fixing film 10 is covered by the heat shield cover 20 and the end portions are covered by the flange members 23*a*, 23*b* thereby intercepting the heat, radiated from the fixing film 10 at the continuous passing of the recording materials P, from diffusion to the exterior.

Also in the present exemplary embodiment, the space (air layer), formed by covering the fixing film 10 with the heat shield cover 20 and the flange members 23*a*, 23*b*, is warmed by the heat radiating from the fixing film 10. Therefore, the warming effect by such space (air layer) achieved a certain reduction in the energy consumption even in continuous passing of the recording materials.

Also the aforementioned structure, in which the heat shield cover 20 is provided on the flange members, is capable of space saving and can also be employed when the printer is made compacter in the future.

As regards the heat shield cover 20, the surface of the heat shield cover 20 opposed to the fixing film 10 may be made smooth by polishing or a chemical treatment, thereby facilitating reflection of the heat, radiated from the fixing film 10, back to the fixing film 10.

Also the heat shield cover 20 may be made, instead of a metal such as aluminum, of a heat insulating member (thermal conductivity 0.1 [W/mK] or less) or of a heat-resistant resin.

Further, the heat shield cover 20 may have a plural-layered structure (not illustrated), for example utilizing a surface-polished metal on the surface of the heat shield cover 20 at the side of the fixing film 10, and a heat insulating member of a low thermal conductivity at the outside.

The heat shield cover 20, constructed not in contact with the frame 5 of the fixing apparatus as described above, can suppress heat dissipation to the outside of the fixing apparatus, thereby suppressing the energy consumption.

Exemplary Embodiment 2

Figure 6A:
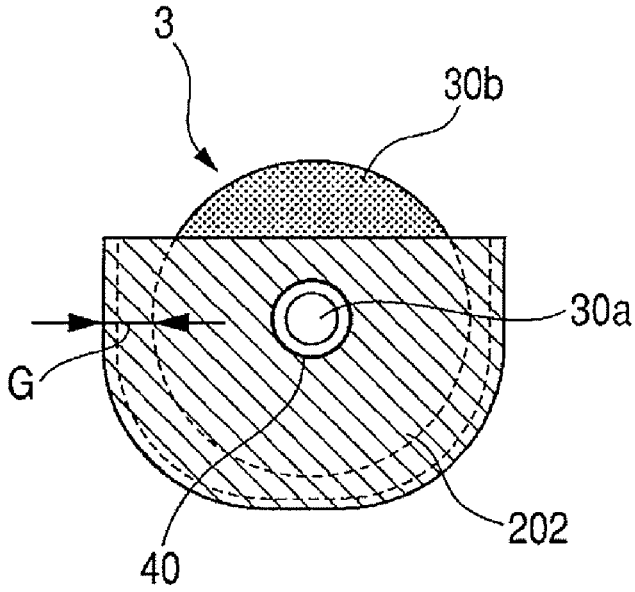
FIGS. 6A and 6B are respectively a cross-sectional view and an elevation view, illustrating the vicinity of a pressurizing rotary member constituting a principal part of an exemplary embodiment 2.
Figure 6B:
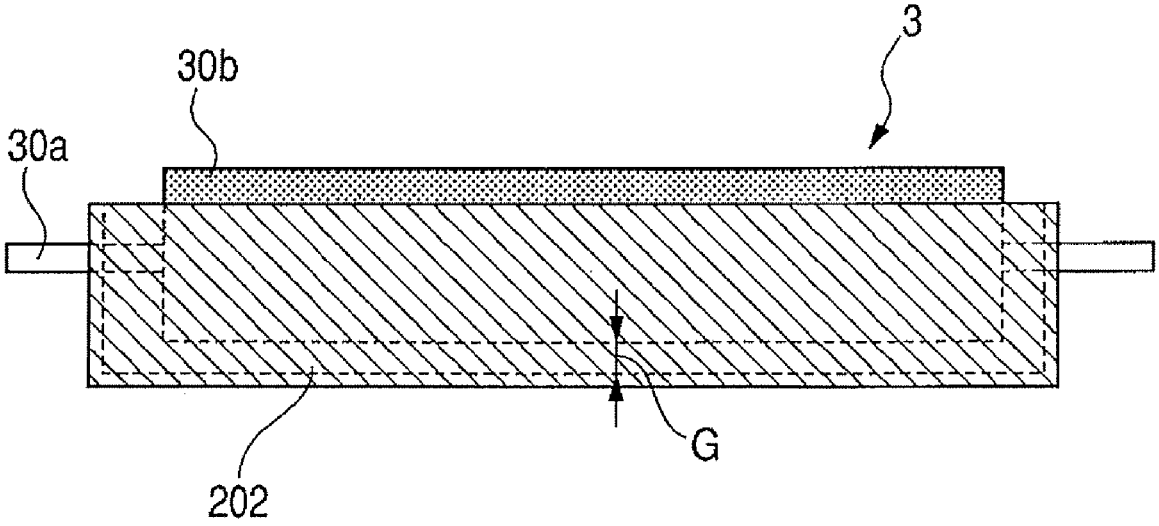

In the following, a second exemplary embodiment of the fixing apparatus will be described with reference to FIGS. 6A and 6B. The entire constructions of the fixing apparatus of the present exemplary embodiment and of the image forming apparatus in which the fixing apparatus is applied, are made similar to those of the fixing apparatus and the image forming apparatus described in the exemplary embodiment 1. Therefore, in the apparatus of the present embodiment, a member equivalent in construction and function is represented by a same reference number, and the description in the exemplary embodiment 1 will be applied, without repeating the description again. FIGS. 6A and 6B illustrate the pressurizing rotary member 3 only, omitting the heat source-side rotary member unit 2.

The fixing apparatus 1 of the present exemplary embodiment is equipped, in addition to the structure of the apparatus of the embodiment 1, with a heat shield cover 202 also on the pressure roller 3 serving as a pressurizing rotary member, so as to cover the surface and end portions thereof. The heat shield cover 202 is made, as in the exemplary embodiment 1, of aluminum of a thickness of 250 μm.

The pressure roller 3 is warmed by the fixing film 10 through the fixing nip portion N, and the heat of thus warmed pressure roller 3 diffuses to the exterior thereby causing a temperature rise in the frame member of the fixing apparatus in the vicinity of the pressurizing member. In order to avoid such temperature rise in the frame member of the fixing apparatus, the pressurizing member is also equipped with the heat shield cover 202 as in the fixing film 10.

FIG. 6A illustrates an end portion of the pressure roller 3 covered by the heat shield cover 202 of the present exemplary embodiment, and FIG. 6B is an elevation view of the pressure roller 3 covered by the heat shield cover 202 of the present exemplary embodiment.

As illustrated in FIGS. 6A and 6B, the member covering the end of the pressure roller 3 is not a flange member as in the embodiment 1 but is the heat shield cover 202 itself. The heat shield cover 202 is connected, as illustrated in FIG. 6A, to a metal core 30*a* of the pressure roller 3, across an end portion heat shield member 40. As the rotational drive is executed by the pressure roller, the metal core 30*a* of the pressure roller is rotatably supported by the heat shield member 40 in order that the heat shield cover 202 does not rotate simultaneously with the rotation of the metal core 30*a*. In this manner, the heat shield cover 202 also is maintained not in contact with the frame of the fixing apparatus.

It is thus made possible to suppress the temperature rise in the frame member, positioned close to the pressure roller 3, of the fixing apparatus, by providing the heat shield cover 202 also on the side of the pressurizing rotary member 3 serving as the pressurizing member, as described above in the present exemplary embodiment, thereby intercepting the heat radiating from the pressure roller 3, by means of the heat shield cover 202.

The distance (gap) G between the heat shield cover 202 and the surface of the pressure roller 3 is preferably 3 mm or less.

Also the surface of the heat shield cover 202 may be polished or chemically treated so as to facilitate reflection of the heat radiating from the pressure roller 3.

It is also possible, as in the exemplary embodiment 1, to provide the end portions of the pressure roller with end members which cover the end portions of the pressure roller, and to connect the heat shield cover to such end members by means of a non-metal heat-resistant material such as a resin, not utilizing a metal such as aluminum (not illustrated).

It is also possible to adopt, in the heat shield cover 202, a multi-layered structure formed by a surface-polished metal on the surface at the side of the pressure roller and by a heat shield material of a low thermal conductivity at the outside (not illustrated).

The heat shield cover 202 in the present fixing apparatus 1 was made in such a formed as to also cover the end surfaces of the pressure roller 3, thereby covering at least about 60% of the surface area of the pressure roller 3 and 60% or more of the end areas. The coverage of the surface of the pressure roller 3 by the heat shield cover 202 is preferably made as large as possible.

Exemplary Embodiment 3

Now a third exemplary embodiment of the fixing apparatus of the present invention will be described with reference to FIGS. 7 and 8. The entire constructions of the fixing apparatus of the present exemplary embodiment and of the image forming apparatus in which the fixing apparatus is applied, are made similar to those of the fixing apparatus and the image forming apparatus described in the exemplary embodiment 1. Therefore, in the apparatus of the present embodiment, a member equivalent in construction and function is represented by a same reference number, and the description in the exemplary embodiment 1 will be applied, without repeating the description again.

In the exemplary embodiments 1 and 2, there has been described a fixing apparatus of film heating type, utilizing a ceramic heater 15. The fixing apparatus of the present exemplary embodiment is of heat roller type, equipped, as the heat source-side rotary member unit, with a fixing roller 4 incorporating a heating member such as a halogen heater 17 and thus utilizing radiation heat.

Figure 7:
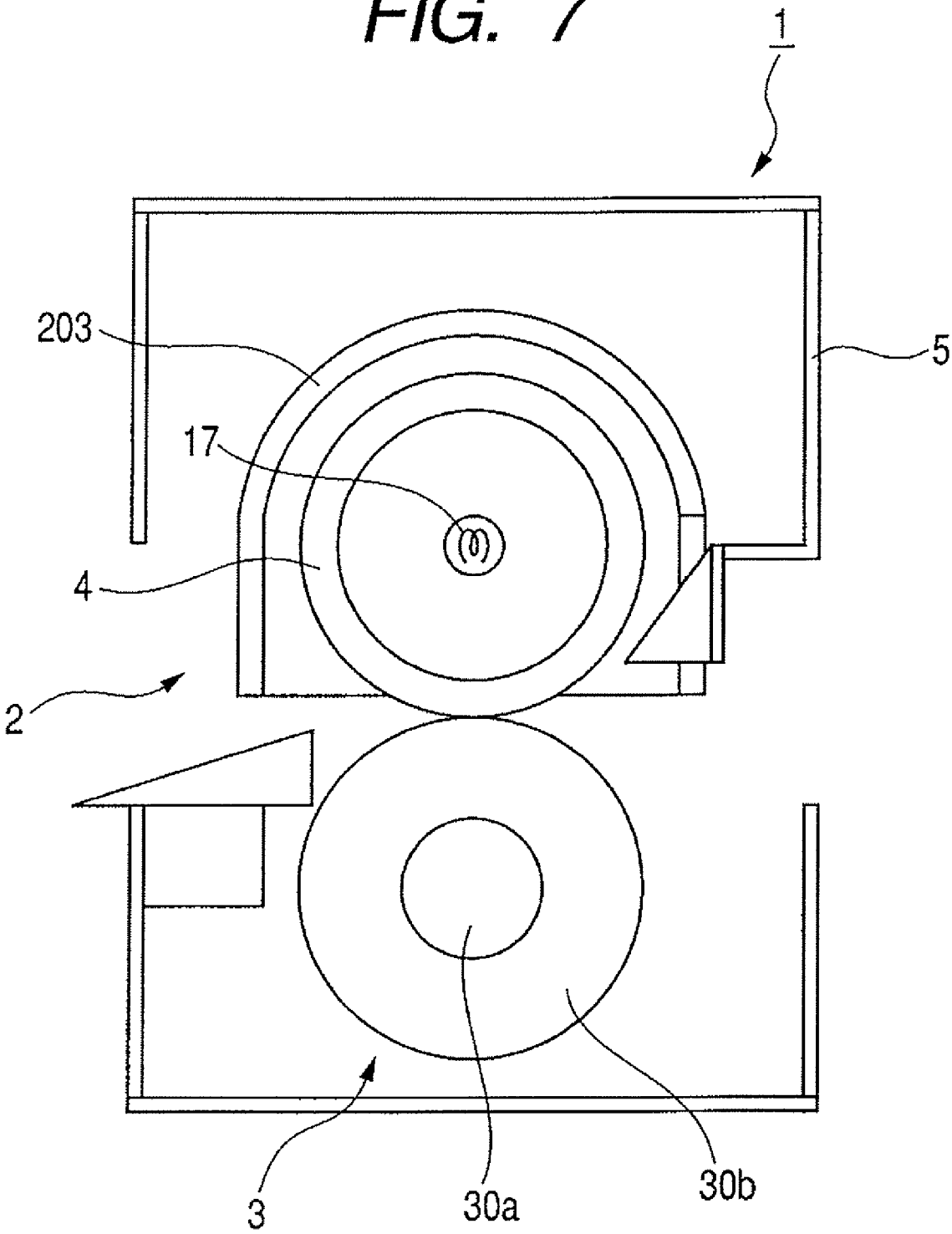
FIG. 7 is a cross-sectional view illustrating a principal part of a fixing apparatus heat roller type, constituting an exemplary embodiment 3.
Figure 8:
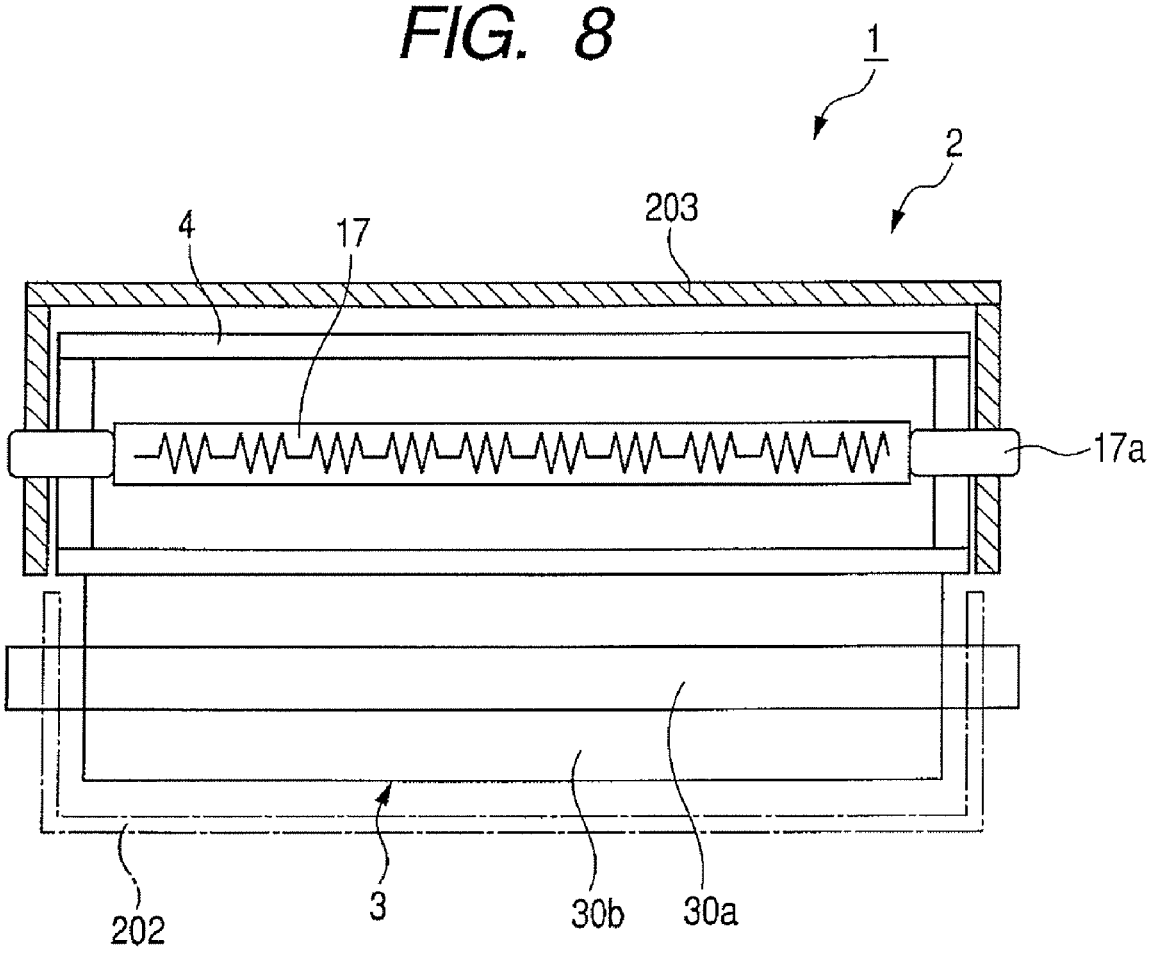
FIG. 8 is an elevational cross-sectional view of the fixing apparatus of heat roller type, illustrated in FIG. 7.
Figure 9:
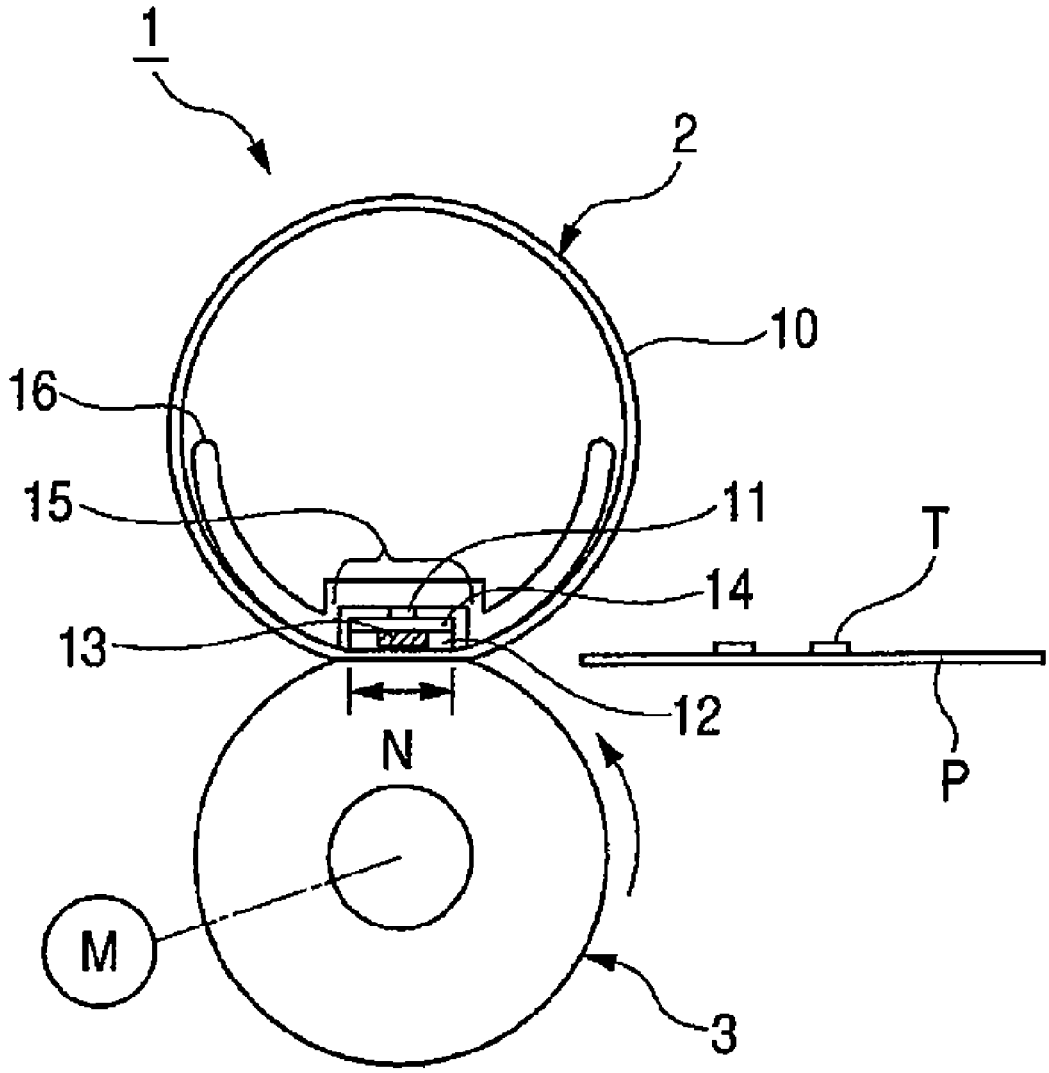
FIG. 9 is a cross-sectional view illustrating a fixing apparatus of film heating type, constituting the background technology of the present invention.

FIG. 7 is a lateral cross-sectional view illustrating the schematic structure of a fixing apparatus of the present exemplary embodiment, and FIG. 8 is a longitudinal cross-sectional view at the center.

Figure 10:
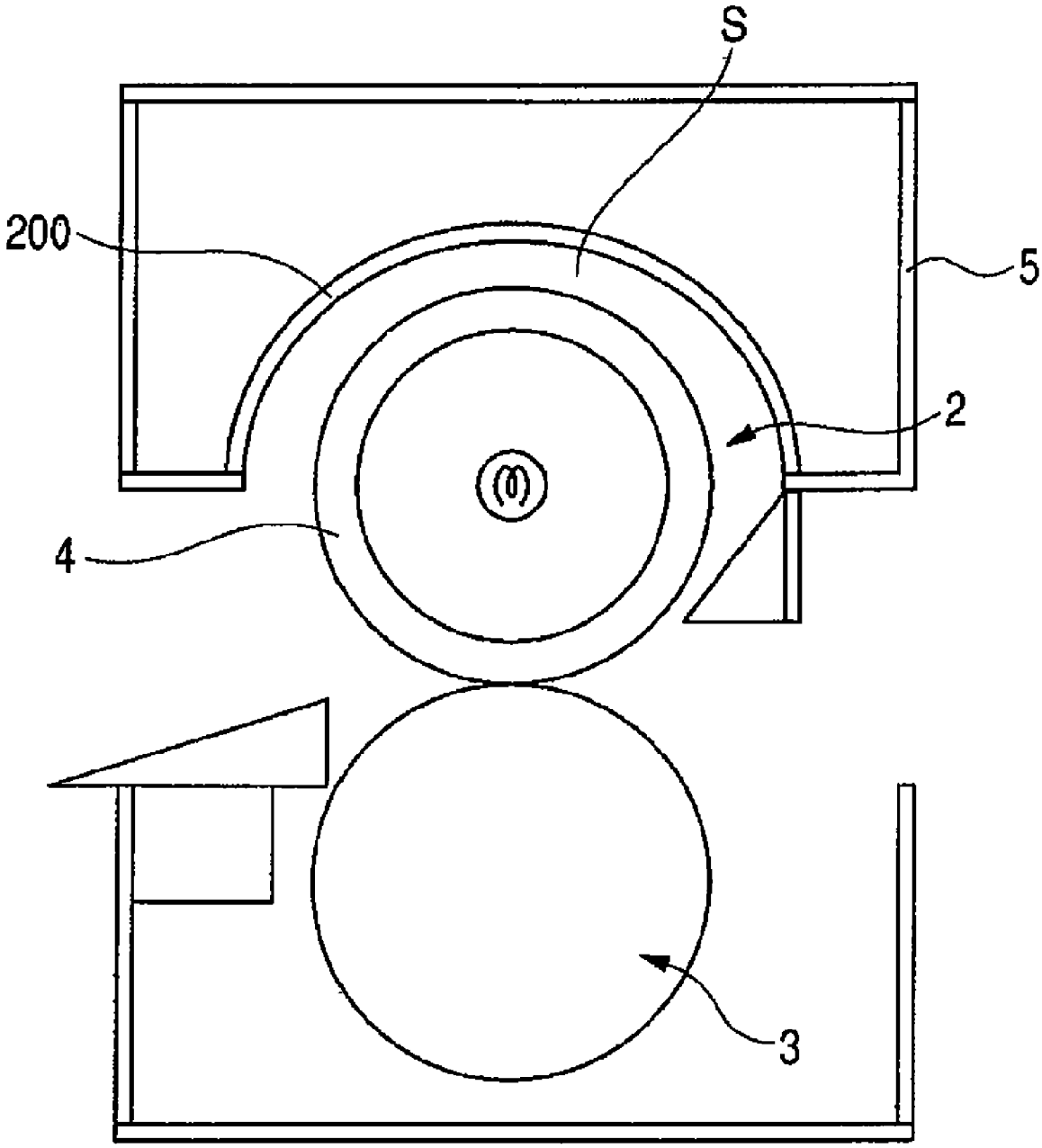
FIG. 10 is a cross-sectional view illustrating a fixing apparatus of heat roller type, constituting the background technology of the present invention.

The structure of the fixing apparatus of the present exemplary embodiment is made similar to that of a heat roller fixing apparatus illustrated in FIG. 10, except for the construction of the heat shield cover and the construction for supporting the heat shield cover.

More specifically, a fixing roller 4, incorporating a heating member (heat-generating unit) such as a halogen heater 17 and utilizing heat of radiation, is provided as the heat source-side rotary member unit 2 as described above, and a pressure roller 3 is provided as the pressurizing rotary member which formed a fixing nip portion N with the fixing roller 4. The fixing roller 4 is constructed as a hollow heat roller, and the pressure roller 3 has a structure similar to that in the exemplary embodiments 1 and 2.

In the fixing apparatus of the present exemplary embodiment, as illustrated in FIG. 8, however, a heat shield cover 203 is connected on rotary shafts 17*a* at both ends of the fixing roller 4. The heat shield cover 203 is made, as in the heat shield cover 20 for the pressure roller 3 of the exemplary embodiment 2, of aluminum and so formed as to integrally cover the surface and the end portions of the fixing roller 4.

The heat shield cover 203 is made in such a construction that, by mounting on the fixing roller 4 constituting the heating member, is separated from the frame 5 (FIG. 10) and covers the fixing roller 4. Such construction enables to prevent the heat, radiating from the fixing roller 4, from diffusion to the exterior, thereby providing effects similar to those in the exemplary embodiments 1 and 2.

Besides, a heat shield cover 202 may also be provided on the side of the pressure roller 3, as in the exemplary embodiment 2 and as indicated by a chain line in FIG. 8.

Furthermore, the heat shield cover 203 may be made, instead of a metal such as aluminum, of a heat insulating member (thermal conductivity 0.1 [W/mK] or less) or of a heat-resistant resin.

Modified Embodiment

The exemplary embodiment 3 has described a fixing apparatus of heat roller type, equipped, as the heat source-side rotary member unit, with a fixing roller incorporating a heating member (heat-generating unit) such as a halogen heater 17 and utilizing heat of radiation.

However, the construction of the present exemplary embodiment 3 may be adopted also in the fixing apparatus of fixing film heating type, utilizing the ceramic heater 15 as the heat source as described in the exemplary embodiments 1 and 2.

More specifically, it is possible, as indicated by chain lines in FIGS. 3A and 3B, to extend the longitudinal end portions of the heat shield cover 201 further to outsides of the end flanges 23*a*, 23*b* in the longitudinal direction, and to assume such a structure as to also cover the end surface areas of the end flanges 23*a*, 23*b*. Also in such case, the heat shield cover 201 is maintained not in contact with the frame member 5.

The foregoing exemplary embodiments have been described on a fixing apparatus to be mounted on an image forming apparatus, but the image heating apparatus of the present invention need not necessarily be mounted on the image forming apparatus. Also the image heating apparatus of the present invention is not regulated to an apparatus for fixing a toner image on a recording material, but includes also a gloss providing apparatus which re-heats a toner image already fixed on a recording material, thereby increasing the gloss of such toner image.

While the present invention has been described with reference to exemplary embodiments, it is to be understood that the invention is not regulated to the disclosed exemplary embodiments. The scope of the following claims is to be accorded the broadest interpretation so as to encompass all such modifications and equivalent structures and functions.

This application claims the benefit of Japanese Patent Application No. 2006-228462 filed Aug. 24, 2006 which is hereby incorporated by reference herein in its entirety.

What is claimed is:

1. An image heating apparatus, comprising:

a tubular fixing film that comes into contact with a toner image borne on a recording material;

a heater that comes into contact with an internal surface of said tubular fixing film;

a backup member that forms a nip portion to pinch and convey the recording material with said heater through said tubular fixing film, wherein said heater heats the toner image on the recording material in the nip portion through said tubular fixing film;

regulation members that regulate displacement of said tubular fixing film, said regulation members being provided at each of portions where end surfaces of said tubular fixing film face said regulation members;

a cover member that covers a surface of said tubular fixing film with a gap between the surface of said tubular fixing film and one surface of said cover member; and a frame that accommodates said tubular fixing film, said heater, said backup member, said regulation members and said cover, wherein said cover is held by said regulation members, and is not in contact with said frame, wherein another gap is provided between an opposite surface of the one surface of said cover member and an inside surface of said frame.

2. An image heating apparatus according to claim 1, further comprising a second cover having a gap between the surface of said backup member and said second cover to cover the surface of said backup member, wherein said second cover is not in contact with said frame.

* * * * *